US012235048B2

(12) United States Patent
Han et al.

(10) Patent No.: US 12,235,048 B2
(45) Date of Patent: Feb. 25, 2025

(54) HEAT EXCHANGER

(71) Applicant: Hanon Systems, Daejeon (KR)

(72) Inventors: Ji Hun Han, Daejeon (KR); Gwang Ok Ko, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 163 days.

(21) Appl. No.: 17/922,115

(22) PCT Filed: Jun. 22, 2021

(86) PCT No.: PCT/KR2021/007808
§ 371 (c)(1),
(2) Date: Oct. 28, 2022

(87) PCT Pub. No.: WO2021/261880
PCT Pub. Date: Dec. 30, 2021

(65) Prior Publication Data

US 2023/0168039 A1 Jun. 1, 2023

(30) Foreign Application Priority Data

Jun. 24, 2020 (KR) ..... 10-2020-0076918

(51) Int. Cl.
*F28D 1/053* (2006.01)
*F28F 1/04* (2006.01)
(Continued)

(52) U.S. Cl.
CPC ..... *F28D 1/05383* (2013.01); *F28F 1/04* (2013.01); *F28F 1/126* (2013.01); *F28F 9/0214* (2013.01)

(58) Field of Classification Search
CPC ..... F28D 1/05383; F28F 1/04; F28F 1/126; F28F 9/0214; F28F 1/025; F28F 1/06; F28F 1/08; F28F 9/16; F28F 9/18
See application file for complete search history.

(56) References Cited

U.S. PATENT DOCUMENTS 5,046,555 A 9/1991 Nguyen
2001/0018970 A1* 9/2001 Nakado ..... F28D 1/0316 165/173

(Continued)

FOREIGN PATENT DOCUMENTS

JP 2017026281 A 2/2017
KR 100590658 B1 6/2006

(Continued)

*Primary Examiner* — Len Tran
*Assistant Examiner* — Kamran Tavakoldavani
(74) *Attorney, Agent, or Firm* — NORTON ROSE FULBRIGHT US LLP

(57) ABSTRACT

The present invention relates to a heat exchanger comprising: a header tank having a plurality of flow paths in which a heat exchange medium flows; multiple rows of tubes connected to the header tank; and heat radiation fins interposed between the tubes, wherein the tubes include a heat exchange part coupled to the heat radiation fins and a coupling part that is formed on a longitudinal end of the heat exchange part and coupled to the header tank, the width of the coupling part is formed to be less than the width of the heat exchange part so that the overall package size of the heat exchanger may be reduced, thus enabling a compact configuration, and the space between neighboring rows of the tubes may be reduced, thus making it possible to reduce the material of the heat radiation fins.

8 Claims, 12 Drawing Sheets

(51) Int. Cl.
*F28F 1/12* (2006.01)
*F28F 9/02* (2006.01)

(56) References Cited

U.S. PATENT DOCUMENTS

| | | | | |
|---|---|---|---|---|
| 2015/0292820 | A1* | 10/2015 | Katoh | B60H 1/00335<br>165/140 |
| 2018/0216892 | A1* | 8/2018 | Kaneko | F28D 1/05341 |

FOREIGN PATENT DOCUMENTS

| | | | |
|---|---|---|---|
| KR | 20090002707 | A | 3/2009 |
| KR | 101250753 | B1 | 4/2013 |
| KR | 101344521 | B1 | 12/2013 |

* cited by examiner

HEAT EXCHANGER

CROSS REFERENCE TO RELATED APPLICATIONS

This application is a national phase under 35 U.S.C. § 371 of International Application No. PCT/KR2021/007808 filed on Jun. 22, 2021, which claims the benefit of priority from Korean Patent Application No. 10-2020-0076918 filed on Jun. 24, 2020. The entire contents of these applications are incorporated herein by reference in their entirety.

TECHNICAL FIELD

The present invention relates to a heat exchanger including multiple rows of tubes through each of which a heat exchange medium flows.

BACKGROUND ART

A heat exchanger is a device that absorbs heat from one side and radiates heat to the other side between two environments having a temperature difference.

Among these heat exchangers, used is an integral heat exchanger including a plurality of independent flow paths positioned in one header tank, and multiple rows of tubes through which heat exchange media respectively flow so that the plurality of different heat exchange media respectively flow.

For example, as shown in FIGS. 1 and 2, a conventional heat exchanger may include a tube slot part 21 positioned in each of a pair of header tanks 30 spaced apart from each other, two rows of the tubes 10 having both ends respectively inserted and coupled to the tube slot parts 21 of the header tanks 30, and a heat radiation fin 11 interposed between the tubes 10. In addition, a partition wall 40 may be coupled into the header tank 30 to partition an inner space of the header tank 30 in a longitudinal direction, thereby dividing a region where the tubes of a first row and the tubes of a second row are connected with each other.

However, in the heat exchanger, the partition wall positioned in the header tank, a sealing structure for airtightness, or the like may be a factor that increases an overall package size of the heat exchanger.

In addition, this structure may act as a limiting factor in reducing a separation distance between the rows of the tubes, which may require a lot of materials in the heat radiation fin when the heat radiation fin is positioned for tubes opposing each other in neighboring rows of the tubes to be coupled together to one heat radiation fin.

RELATED ART DOCUMENT

Patent Document

KR 10-1344521 B1 (Dec. 17, 2013)

DISCLOSURE

Technical Problem

An object of the present invention is to provide a heat exchanger having a compact configuration due to its reduced overall package size by including multiple rows of tubes through each of which a heat exchange medium flows.

Technical Solution

In one general aspect, a heat exchanger includes: a header tank including a plurality of flow paths through which a heat exchange medium flows; multiple rows of tubes connected to the header tank; and a heat radiation fin interposed between the tubes, wherein the tube includes a heat exchange part coupled to the heat radiation fin and a coupling part positioned at a longitudinal end of the heat exchange part to be coupled to the header tank, and the coupling part has a width less than a width of the heat exchange part.

In addition, the flow paths through which the plurality of heat exchange media having different temperatures respectively flow may be positioned independently from each other, the header tank may be an integral heat exchanger and the tubes may be positioned independently from each other, and inlets through which the respective heat exchange media are introduced into the header tank may be positioned in the same header tank.

In addition, the coupling part of the tube may have a thickness greater than a thickness of the heat exchange part.

In addition, the tube may include a connection part connecting the heat exchange part and the coupling part with each other, and the connection part may be inclined at an acute angle with respect to each of extension lines of the heat exchange part and the coupling part.

In addition, the tube may be an integral tube in which the heat exchange part, the connection part, and the coupling part are connected with one another as one entity by deforming an end of the tube having a constant cross-sectional shape by plastic processing.

In addition, the header tank may include the flow paths positioned independently from each other by a partition positioned in the header tank.

In addition, the header tank may include: a header including multiple rows of tube insertion holes into which the tube is inserted; a tank coupled to the header to have a space in which the heat exchange medium flows; and a partition coupled to the header and the tank to partition the inner space of the tank, wherein the coupling part of the tube is inserted and coupled to the tube insertion hole.

In addition, the partition may be integral with the tank, and further includes a gasket interposed between an end of the partition and the header.

In addition, a width A of the coupling part of the tube may satisfy Equation 1 below:

$$A=(D-W)\pm 1.0 \quad \text{(Equation 1)}$$

(D: width of heat exchange part, and W: transverse width of gasket interposed between end of partition and header).

In addition, the coupling part of the tube may have a thickness greater than a thickness of the heat exchange part, and a thickness B of the coupling part of the tube may satisfy Equation 2 below:

$$B=\frac{2\times(D-C)+(C\times\pi)-2A}{2}\pm 1.0 \quad \text{(Equation 2)}$$

(A: width of coupling part, C: thickness of heat exchange part, and D: width of heat exchange part).

In addition, the heat radiation fin may be positioned for tubes opposing each other in neighboring rows of the tubes to be coupled together to one heat radiation fin.

Advantageous Effect

The present invention may provide the heat exchanger having a compact configuration by reducing its overall package size.

The present invention may also require less materials in the heat radiation fin by reducing the space between the neighboring rows of the tubes when the heat radiation fin is positioned for the tubes opposing each other in the neighboring rows of the tubes to be coupled together to one heat radiation fin.

BEST MODE

Hereinafter, a heat exchanger of the present invention, having the above-described configuration, is described in detail with reference to the accompanying drawings.

Figure 1:
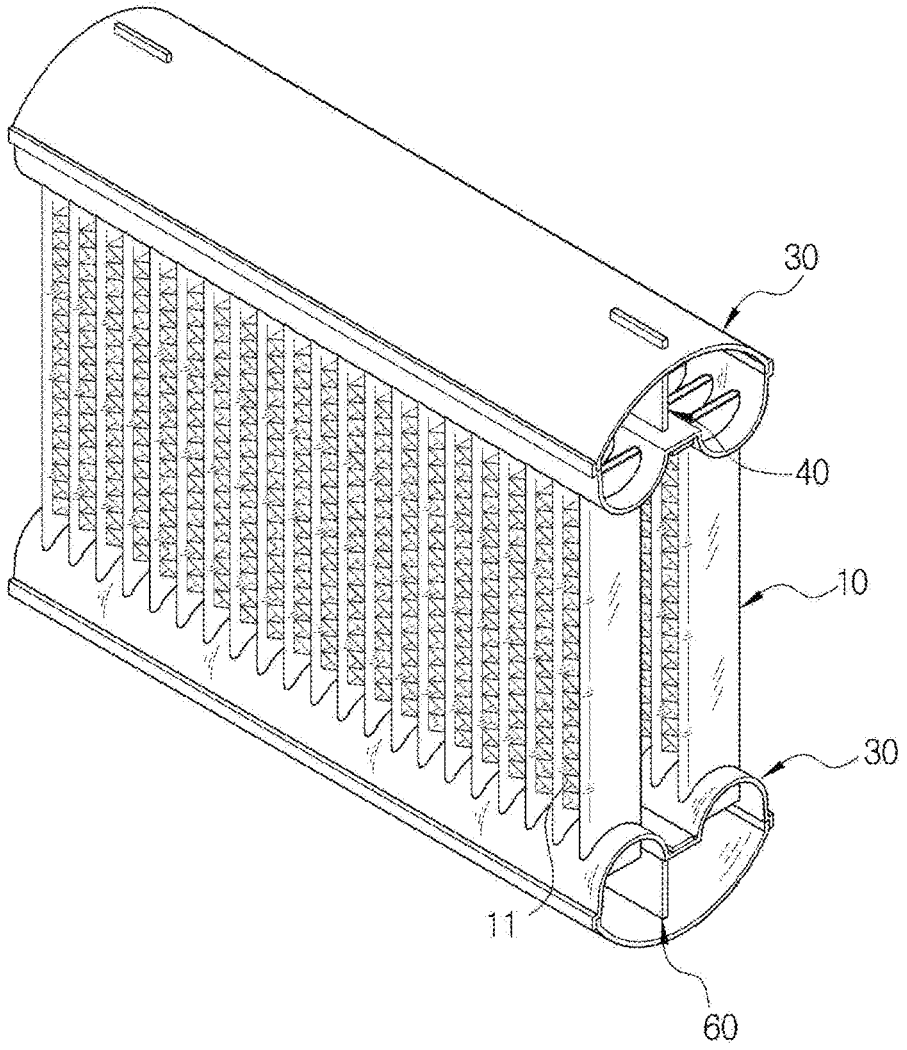
FIGS. 1 and 2 are an assembled perspective view and an exploded perspective view respectively showing a conventional heat exchanger including two rows of tubes.
Figure 2:
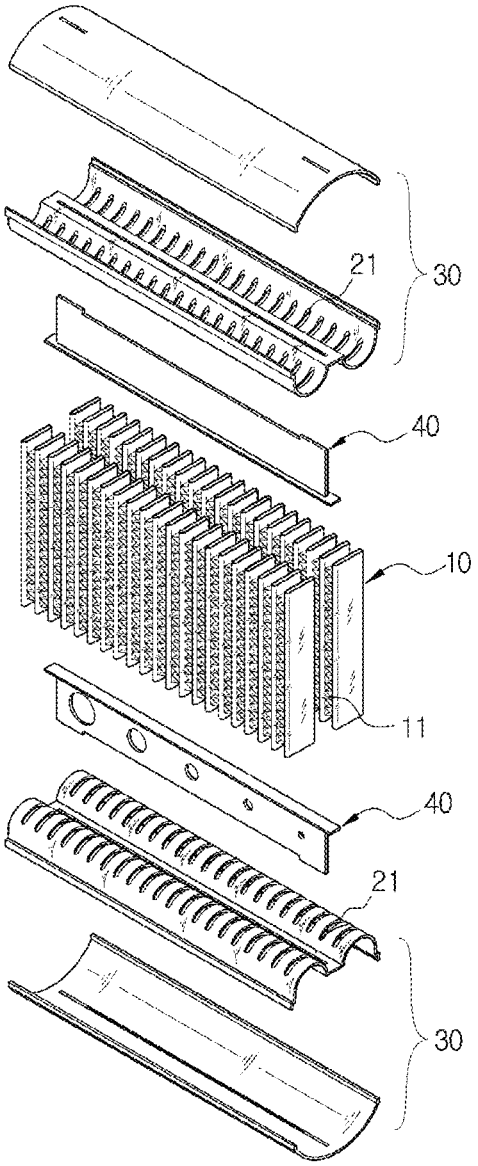
Figure 3:
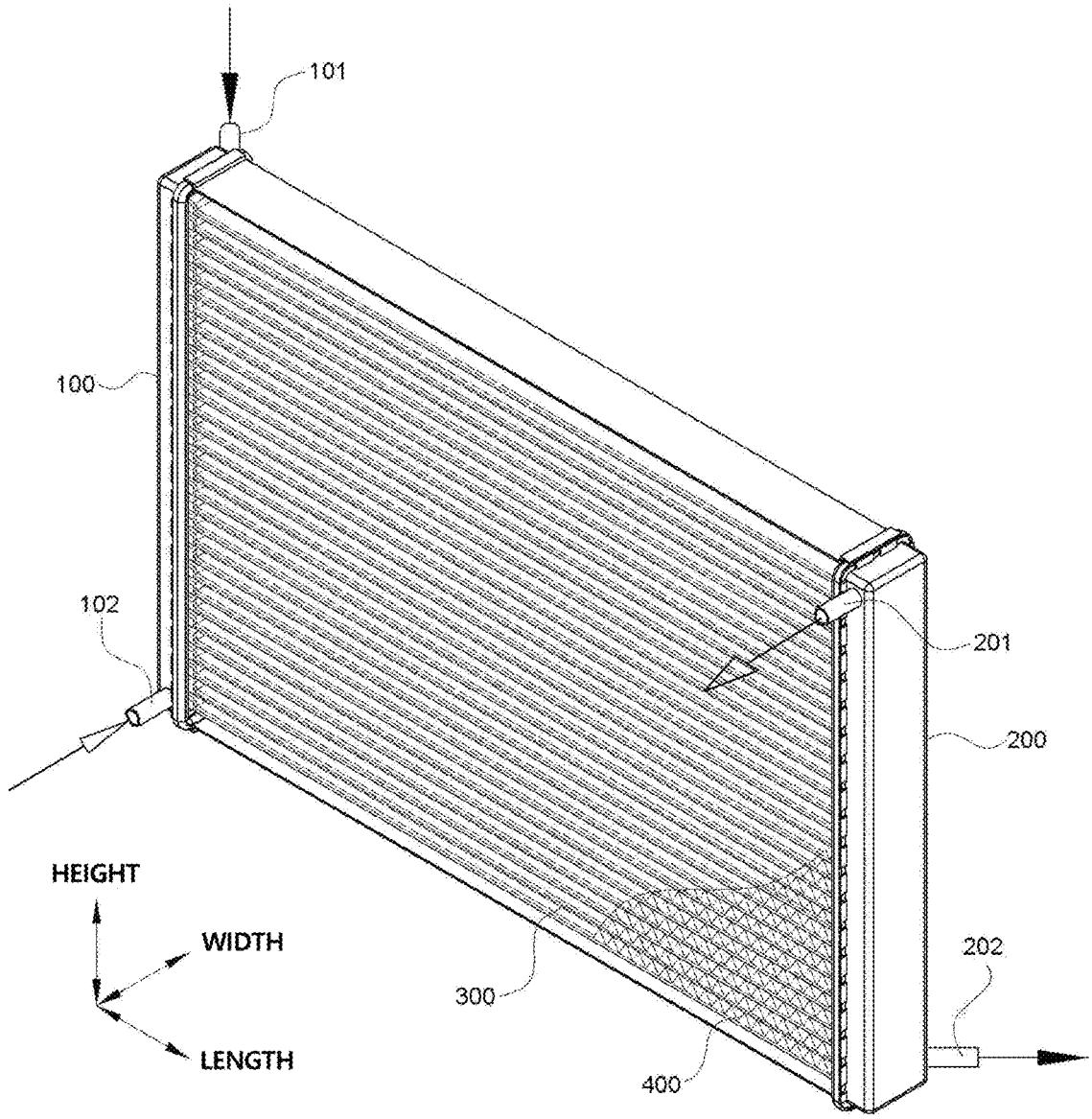
FIGS. 3 to 5 are an assembled perspective view, an exploded perspective view and a partially enlarged view respectively showing a heat exchanger according to an embodiment of the present invention.
Figure 4:
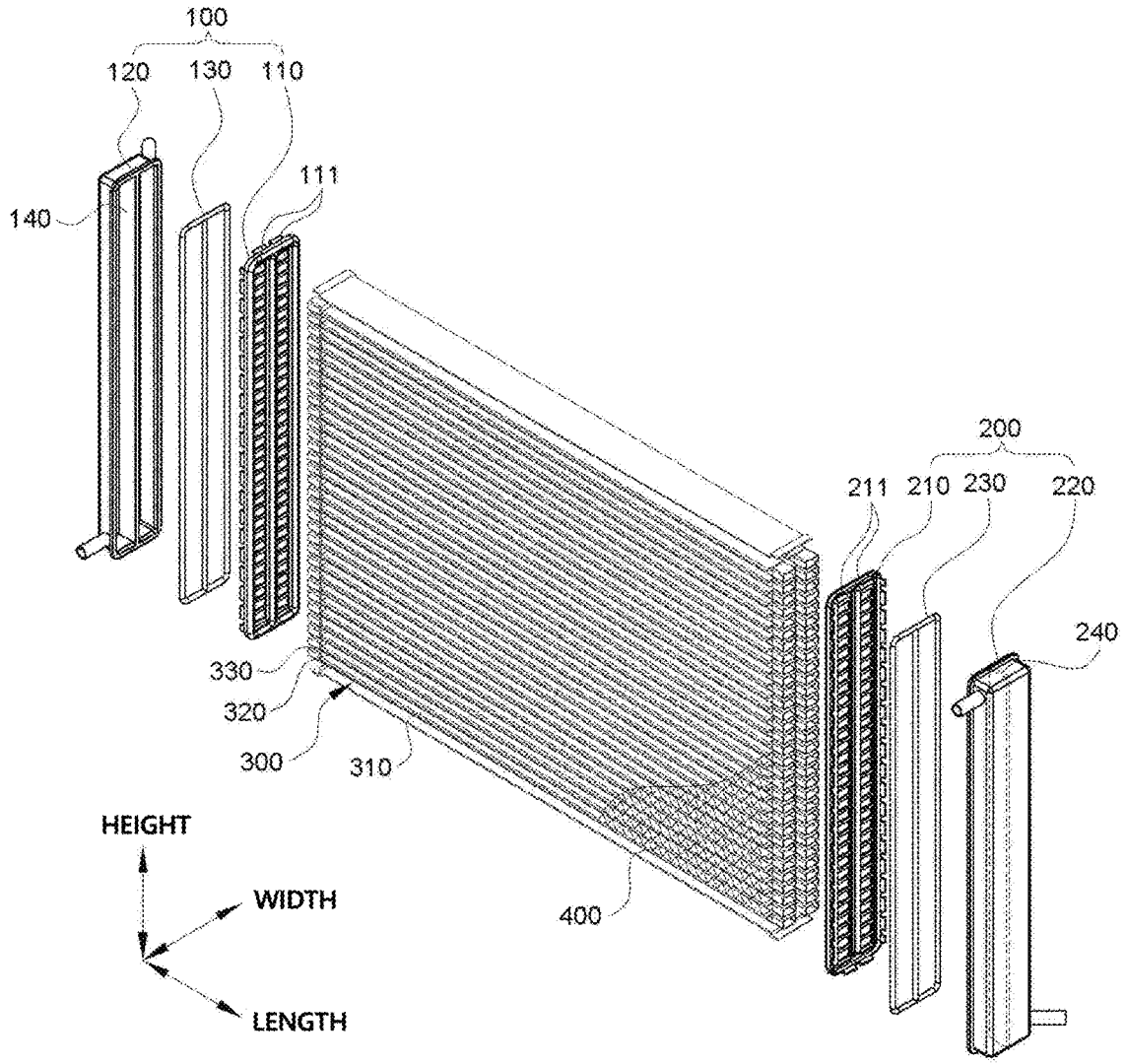
Figure 5:
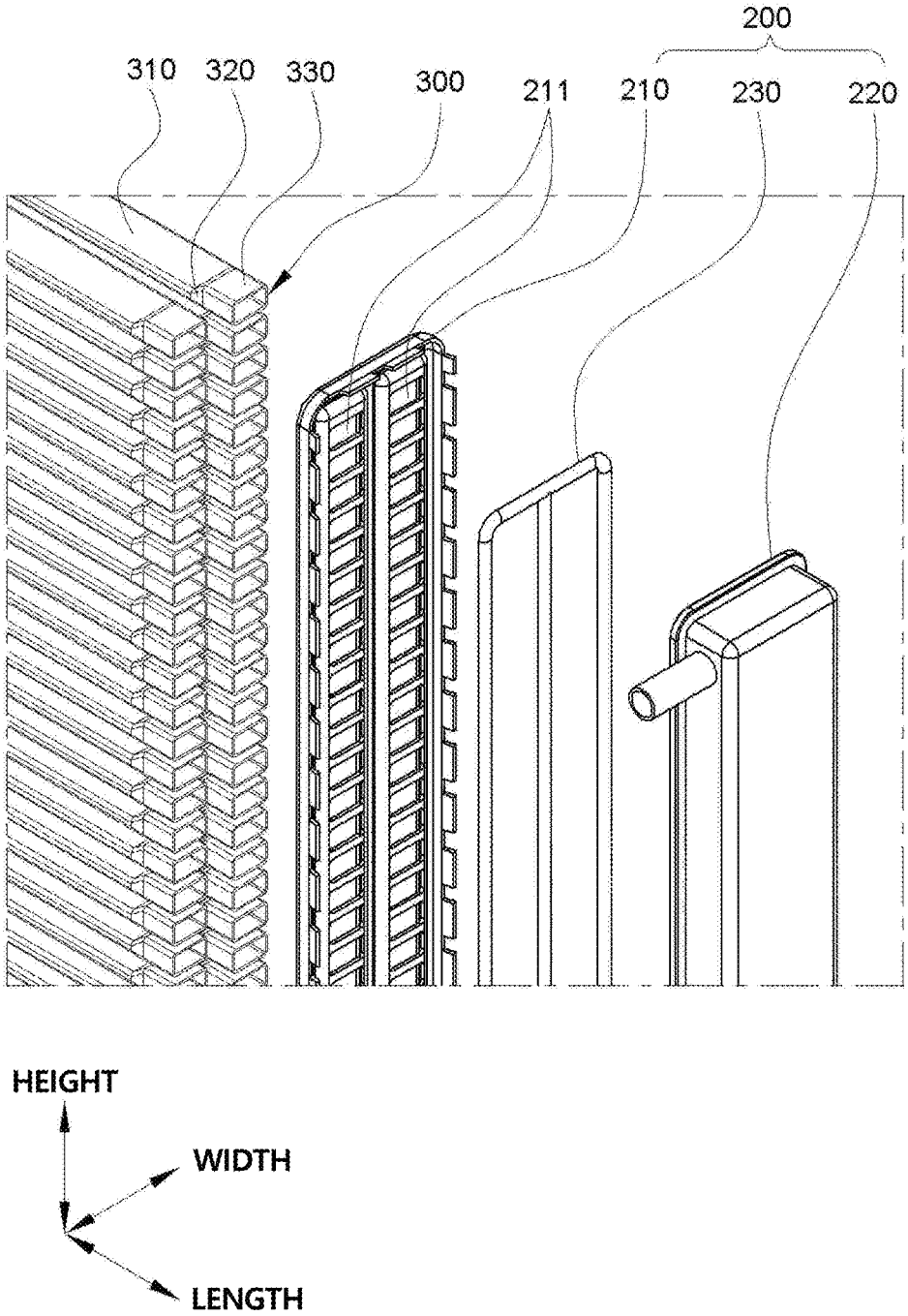
Figure 6:
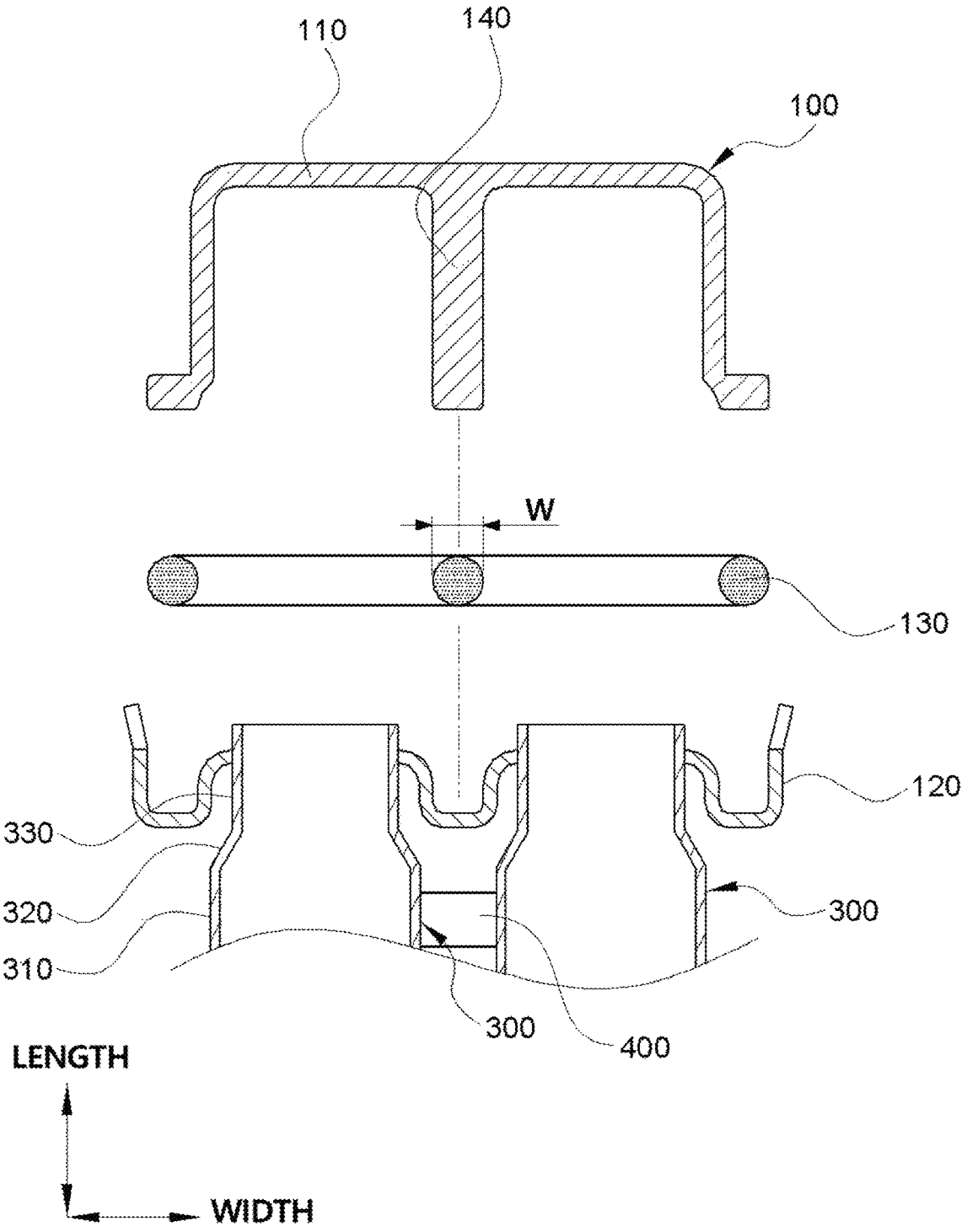
FIGS. 6 and 7 are an exploded cross-sectional view and an assembled cross-sectional view respectively showing the heat exchanger according to an embodiment of the present invention.
Figure 7:
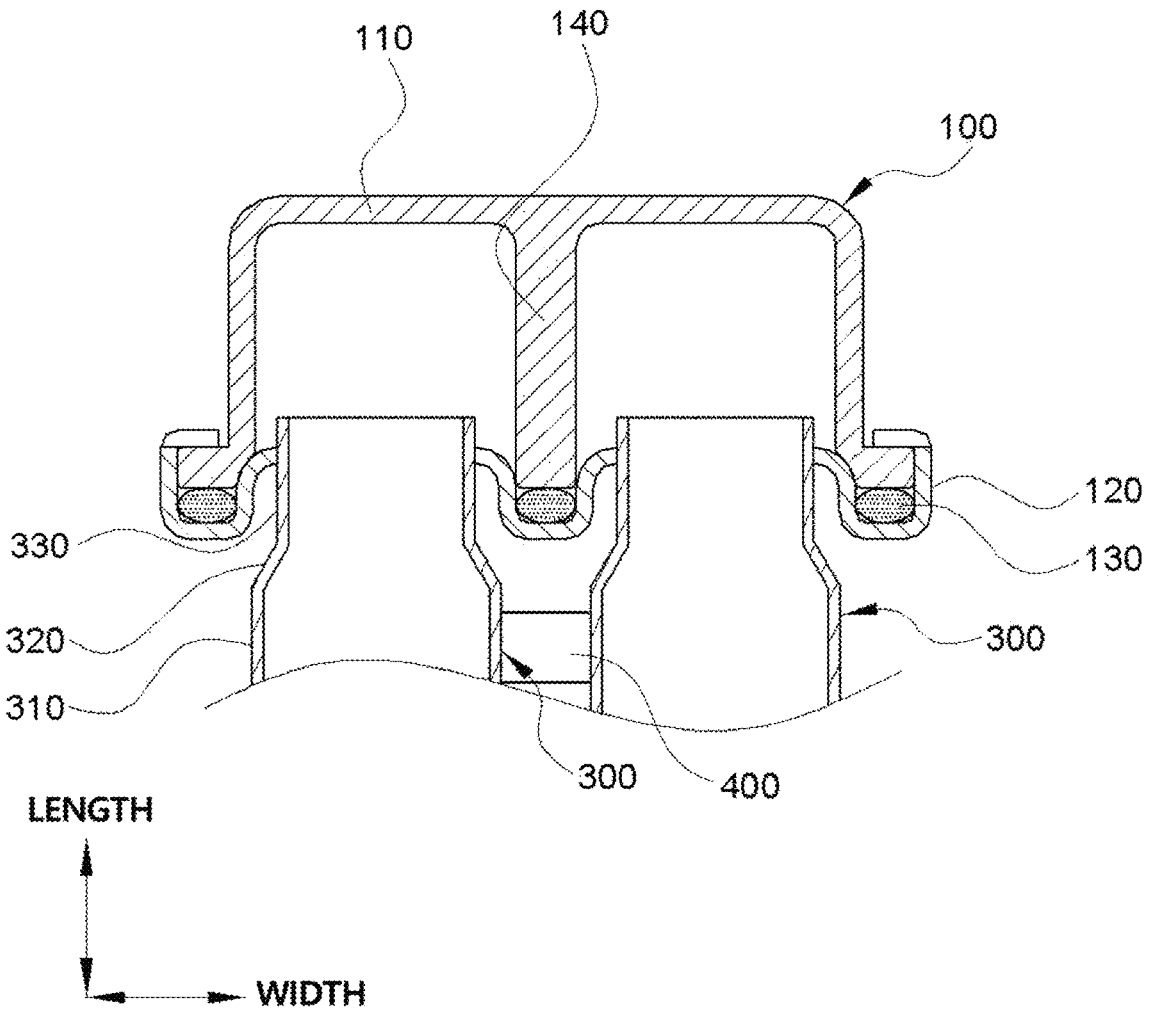
Figure 8:
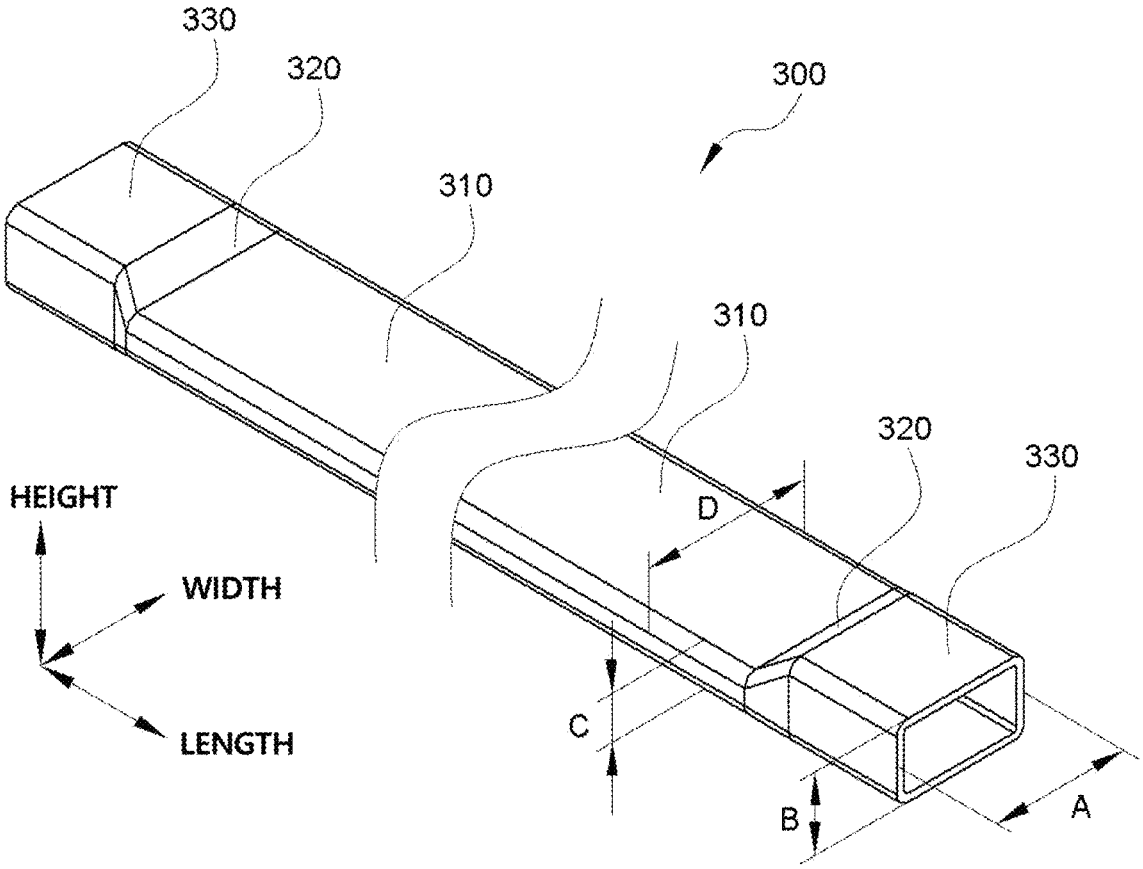
FIGS. 8 to 11 are a perspective view, a side view, a plan view and a front view respectively showing a tube of the heat exchanger according to an embodiment of the present invention.
Figure 9:
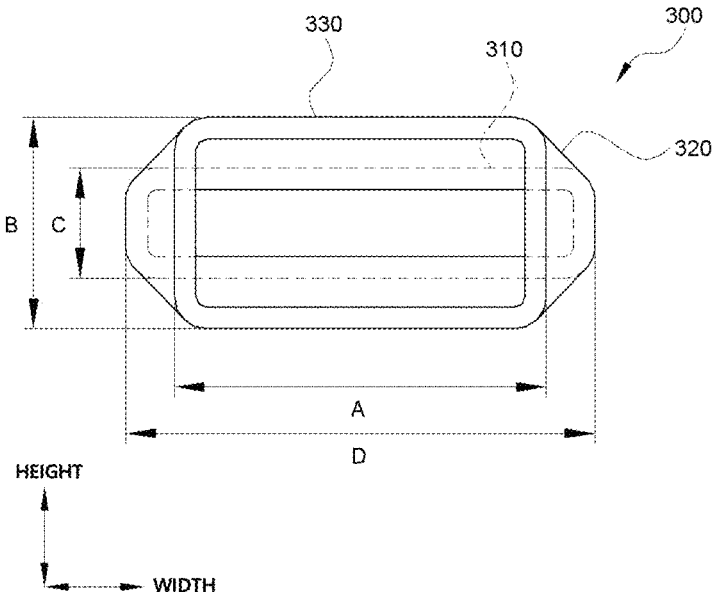
Figure 10:
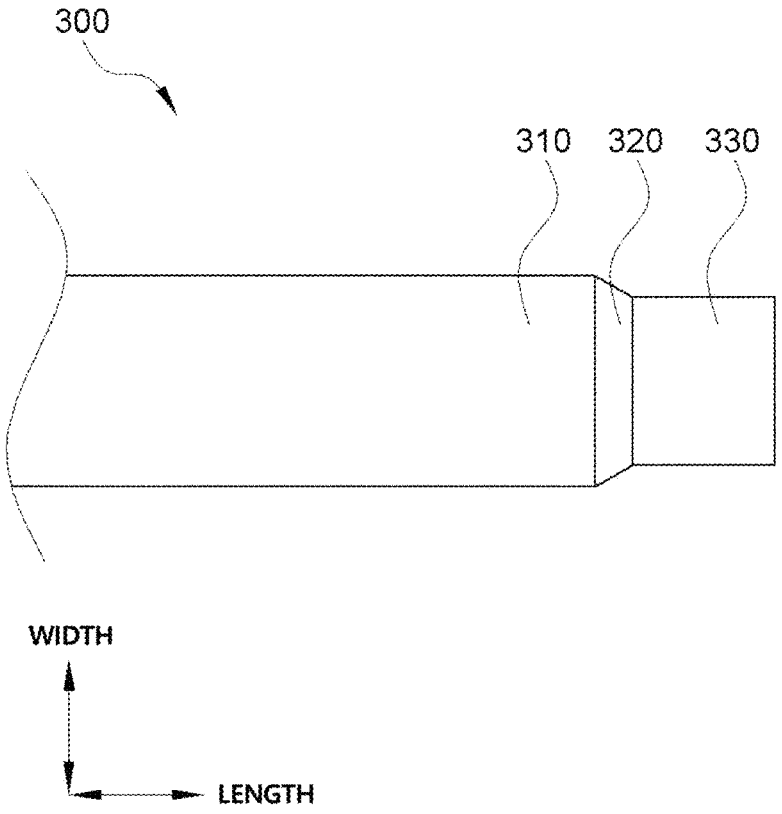
Figure 11:
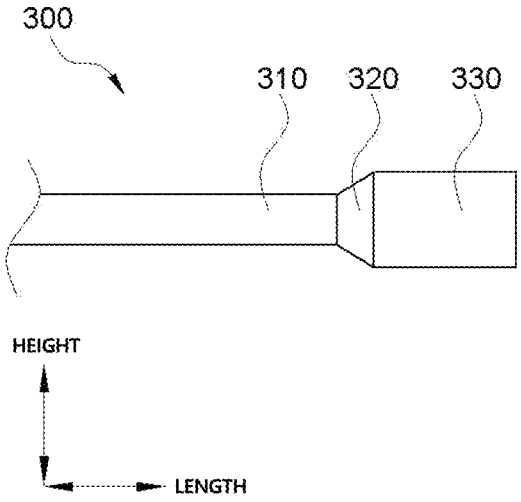

FIGS. 3 to 5 are an assembled perspective view, an exploded perspective view and a partially enlarged view respectively showing a heat exchanger according to an embodiment of the present invention; and FIGS. 6 and 7 are an exploded cross-sectional view and an assembled cross-sectional view respectively showing the heat exchanger according to an embodiment of the present invention.

As shown in the drawings, the heat exchanger according to an embodiment of the present invention may roughly include a first header tank 100, a second header tank 200, a tube 300 and a heat radiation fin 400.

A pair of header tanks may be provided, and the pair of header tanks may include the first header tank 100 and the second header tank 200. The first header tank 100 and the second header tank 200 may each have a space in which a heat exchange medium may be stored and flow, and the first header tank 100 and the second header tank 200 may be positioned parallel to each other while being spaced apart from each other. In addition, the first header tank 100 may include a first header 110, a first tank 120, a first gasket 130, and a first partition 140. The first header 110 may include tube insertion holes 111 into each of which the tube 300 may be inserted, and the tube insertion holes 111 may be spaced apart from each other in a longitudinal direction of the first header 110 and arranged in two rows. Here, the first tank 120 may be coupled to the first header 110 to have a space in which the heat exchange medium may flow, and for example, the first tank 120 may have an approximately half-pipe shape. The first partition 140 may be integral with the first tank 120 by including one end coupled to the first tank 120, or the first partition 140 may be formed separately from the first tank 120 and then coupled thereto. The first gasket 130 may be positioned along the periphery of the first header 110 and the center in a width direction of the first header 110, in a longitudinal direction of the heat exchanger, and inserted into a recessed seating groove connected thereto, and the first gasket 130 may have a shape corresponding to that of the seating groove of the first header 110 and have a circular cross-section. Therefore, the first tank 120 including the first partition 140 may be coupled to the first header 110 in a state where the first gasket 130 is inserted into the seating groove of the first header 110, the periphery of the first gasket 130 may thus be in close contact with a gap between an end of the first tank 120 and the first header 110 to close the gap, and the center of the first gasket 130 may be in close contact with a gap between an end of the first partition 140 and the first header 110 to close the gap. Accordingly, the first header tank 100 may include independent flow paths of the heat exchange media positioned on both sides thereof with respect to the first partition 140 in the width direction. Similarly, the second header tank 200 may also include a second header 210, a second tank 220, a second gasket 230, and a second partition 240. The second header 210 may include tube insertion holes 211 arranged in two rows, the second gasket 230 may close a gap between the second header 210 and the second tank 220 and a gap between the second partition 240 and the second header 210, and accordingly, the second header tank 200 may include independent flow paths of the heat exchange media positioned on both sides thereof with respect to the second partition 240 in the width direction. In addition, the first header tank 100 may include a first inlet pipe 101 through which one heat exchange medium is introduced and a second inlet pipe 102 through which another heat exchange medium is introduced, and the second header tank 200 may include a first outlet pipe 201 through which one heat exchange medium is discharged and a second outlet pipe 202 through which another heat exchange medium is discharged.

The tube 300 may be a tube having a flow path so that the heat exchange medium flows along the inside thereof, and for example, may be a tube having a thickness less than its width. In addition, the tube 300 may be arranged in two rows. In addition, the tube 300 may have one end coupled and communicated with the first header tank 100 and the other end coupled and communicated with the second header tank 200. Here, coupling parts 330 may be positioned at both longitudinal ends of the tube 300, and the coupling parts 330 may be inserted into the tube insertion holes 111 and 211 respectively positioned in the first header tank 100 and the second header tank 200, and then respectively coupled to the header tanks by brazing or the like. In addition, a heat exchange part 310 may be positioned between the coupling parts 330 positioned at both the longitudinal ends of the tube 300, and the heat exchange part 310 may be a part to which the heat radiation fin 400 is coupled. In addition, the coupling part 330 of the tube 300 may have a width less than a width of the heat exchange part 310. That is, the coupling part 330 of the tube 300 may have a relatively reduced width, and positioned at each of the two longitudinal ends of the heat exchange part 310. Here, the tube 300 may include the coupling part 330 having the width less than that of the heat exchange part 310. That is, for example, the tube 300 may include the coupling part 330 having the width reduced compared to the width of the heat exchange part 310, and a thickness increased compared to a thickness of the heat exchange part 310 through a plastic processing in which the end of a tube having a constant cross-sectional shape is deformed by being spread out in its thickness direction and compressed in its width direction. Therefore, the tube 300 may include a connection part 320 connecting the heat exchange part 310 and the coupling part 330 with each other while being interposed therebetween, and the connection part 320 may be inclined at an acute angle with respect to the heat exchange part 310 and the coupling part 330. That is, the tube 300 may be an integrated tube in which the heat exchange part 310, the connection part 320, and the coupling part 330 are connected with one another as one entity without a seam. Here, the connection parts 320 positioned on each of the two sides of the tube 300 in the width direction may be inclined to have a width gradually decreased toward the coupling part 330 from the heat exchange part 310, and the connection parts 320 positioned on each of the two sides of the tube 300 in a thickness direction of the heat exchanger may be inclined to have a thickness gradually increased toward the coupling part 330 from the heat exchange part 310. In addition, the connection part 320 may have respective acute angles with extension lines of the heat exchange part 310 and the coupling part 330, and the heat exchange medium may thus smoothly flow therein.

The heat radiation fin 400 may be interposed between the tubes 300 arranged in the longitudinal direction and coupled to the tubes 300 by brazing or the like. In addition, for example, the heat radiation fin 400 may be positioned for the tubes 300 opposing each other in neighboring rows of the tubes to be coupled together to one heat radiation fin 400. That is, the tubes of the first row and the tubes of the second row that are adjacent to each other may be coupled to one heat radiation fin, and the tubes 300 in the neighboring tube row are connected with each other by one heat radiation fin 400.

Therefore, the heat exchanger of the present invention may have a compact configuration due to its reduced overall package size by reducing the width of the header tank included in the heat exchanger, reducing a space between the rows of the tubes, and thus reducing the outermost width of the rows of the tubes. In addition, the heat exchanger of the present invention may also require less materials in the heat radiation fin by reducing the space between the neighboring rows of the tubes.

FIGS. 8 to 11 are a perspective view, a side view, a plan view and a front view respectively showing a tube of the heat exchanger according to an embodiment of the present invention.

A width A of the coupling part 330 of the tube 300 may satisfy Equation 1 below:

$$A=(D-W)\pm 1.0 \quad \text{(Equation 1)}$$

(D: Width of heat exchange part, and W: Transverse width of gasket interposed between end of partition and header).

Figure 12:
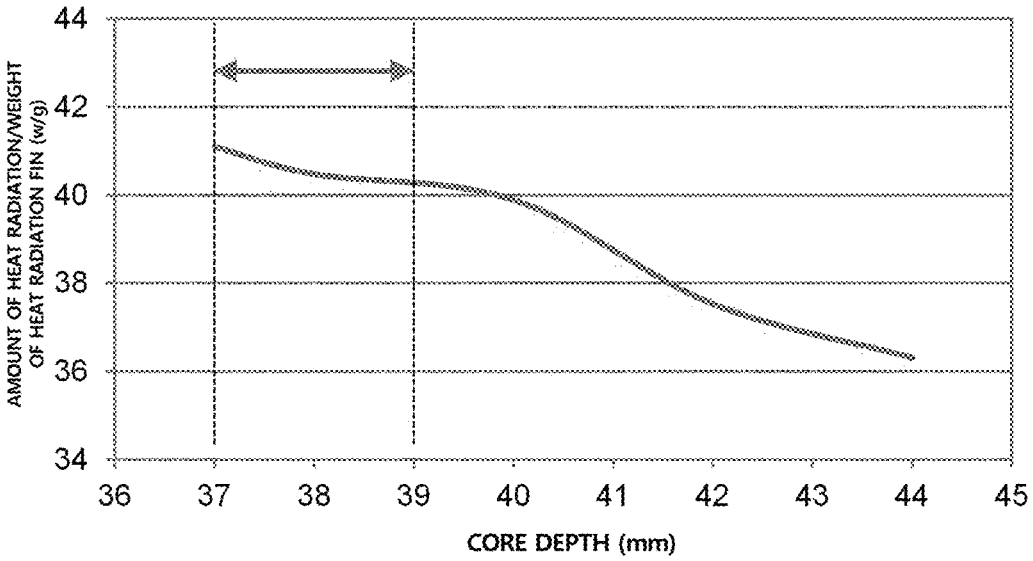
FIG. 12 is a graph showing heat radiation efficiency based on a core depth, which is the outermost width of two rows of tubes in the heat exchanger according to an embodiment of the present invention.

That is, when the width A of the coupling part 330 satisfies the above dimensions, it is possible to secure performance efficiency (or an amount of heat radiation relative to a weight of the heat radiation fin, w/g) within a section indicated by an arrow in the graph of FIG. 12. Here, a core depth may be the outermost width of the two rows of the tubes in the width direction.

In addition, the coupling part 330 of the tube 300 may have a thickness greater than a thickness of the heat exchange part 310, and a thickness B of the coupling part 330 of the tube 300 may satisfy Equation 2 below:

$$B=\frac{2\times(D-C)+(C\times\pi)-2A}{2}\pm 1.0 \quad \text{(Equation 2)}$$

(A: Width of coupling part, C: Thickness of heat exchange part, and D: Width of heat exchange part).

That is, the coupling part 330 of the tube 300 may be formed by deforming an end of the tube by the plastic processing, and accordingly, the material of the tube 300 may not be torn during the plastic processing only when the thickness B of the coupling part 330 satisfies the above dimensions.

In addition, in the heat exchanger according to an embodiment of the present invention, the flow paths through which the plurality of heat exchange media having different temperatures respectively flow, may be positioned independently from each other, and the first inlet pipe 101 and the second inlet pipe 102, i.e., inlets through which the heat exchange media are respectively introduced into the first header tank 100 and the second header tank 200, may be positioned in the same header tank. That is, as shown in the drawings, both the first inlet pipe 101 through which one heat exchange medium is introduced and the second inlet pipe 102 through which the other heat exchange medium is introduced may be positioned in the first header tank 100. In addition, both the first outlet pipe 201 through which one heat exchange medium is discharged and the second outlet pipe 202 through which the other heat exchange medium is discharged may be positioned in the second header tank 200.

Figure 13:
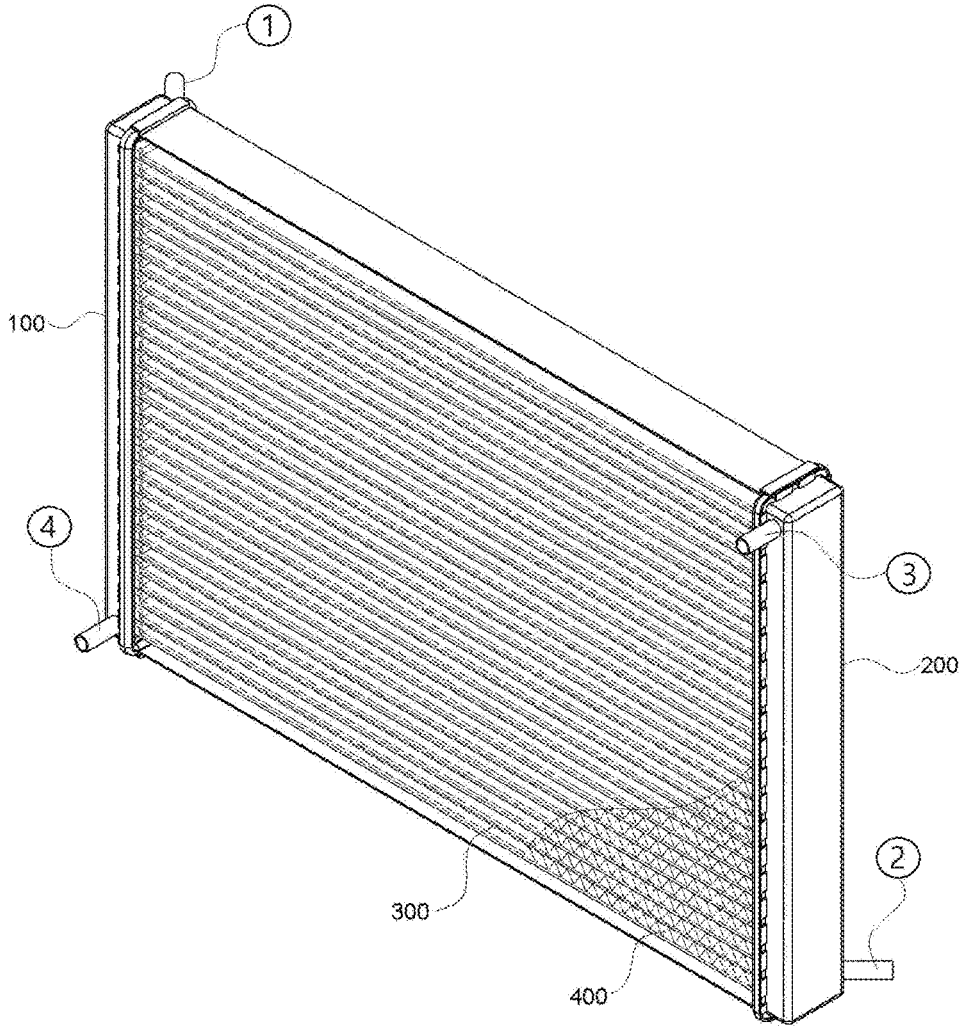
FIGS. 13 and 14 are graphs respectively showing an arrangement of the inlets and outlets of different heat exchange media and an amount of heat radiation based thereon in the heat exchanger according to an embodiment of the present invention.
Figure 14:
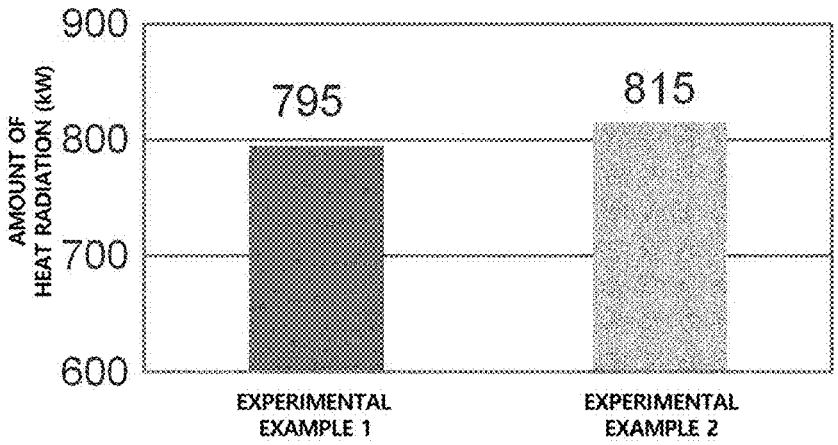

Therefore, as experimental examples, nos. 1 to 4 respectively indicate the inlet pipes and outlet pipes positioned in the header tanks of the heat exchanger as shown in FIG. 13. Here, Experimental Example 1 indicates a case where heat radiation performance is tested by positioning the inlets of the different heat exchange media in the different header tanks, as shown in Table 1 below, and Experimental Example 2 indicates a case where the heat radiation performance is tested by positioning the inlets of the different heat exchange media in one (or the same) header tank as described above. Referring to FIG. 14, it may be seen that Experimental Example 2 shows higher heat radiation performance.

| | ① | ② | ③ | ④ |
|---|---|---|---|---|
| Experimental Example 1 | Inlet of first heat exchange medium | Outlet of first heat exchange medium | Inlet of second heat exchange medium | Outlet of second heat exchange medium |
| Experimental Example 2 | Inlet of first heat exchange medium | Outlet of first heat exchange medium | Outlet of second heat exchange medium | Inlet of second heat exchange medium |

In addition, for example, air, which is a cooling fluid, may be configured to cool the heat exchanger as air flows from the front to the rear. In this case, a heat exchange medium having a lower temperature may flow in the tubes of the first row positioned at the front and a heat exchange medium having a higher temperature may flow in the tubes of the second row positioned at the rear, thereby improving the heat radiation performance. In addition, the flow path of the heat exchange medium may be a cross-flow or U-flow type.

The present invention is not limited to the above-mentioned embodiments, and may be variously applied. In addition, the present invention may be variously modified by those skilled in the art to which the present invention pertains without departing from the gist of the present invention claimed in the claims.

DESCRIPTION OF REFERENCE NUMERALS

100: first header tank, 101: first inlet pipe
102: second inlet pipe, 110: first header
111: tube insertion hole, 120: first tank
130: first gasket, 140: first partition
200: second header tank, 201: first outlet pipe
202: second outlet pipe 202, 210: second header
211: tube insertion hole, 220: second tank
230: second gasket, 240: second partition
300: tube, 310: heat exchange part
320: connection part, 330: coupling part
A: width of the coupling part, B: thickness of coupling part
C: thickness of heat exchange part, D: width of heat exchange part
W: transverse width of gasket interposed between end of partition and header
400: heat radiation fin

The invention claimed is:

1. A heat exchanger comprising:

a header tank including a plurality of flow paths through which a heat exchange medium flows;

multiple rows of tubes connected to the header tank; and a heat radiation fin interposed between the tubes, wherein the tube includes a heat exchange part coupled to the heat radiation fin and a coupling part positioned at a longitudinal end of the heat exchange part to be coupled to the header tank, and the coupling part has a width less than a width of the heat exchange part, wherein the header tank includes:

the flow paths positioned independently from each other by a partition positioned in the header tank, a header including multiple rows of tube insertion holes into which the tube is inserted;

a tank coupled to the header to have a space in which the heat exchange medium flows; and a partition coupled to the header and the tank to partition the inner space of the tank, wherein the coupling part of the tube is inserted and coupled to the tube insertion hole, wherein the partition is integral with the tank, and further includes a gasket interposed between an end of the partition and the header, wherein a width A of the coupling part of the tube satisfies Equation 1 below:

$$A=(D-W)\pm 1.0 \quad \text{(Equation 1)}$$

wherein D is a width of heat exchange part, and W is a transverse width of gasket interposed between end of partition and header.

2. The heat exchanger of claim 1, wherein the flow paths through which the plurality of heat exchange media having different temperatures respectively flow are positioned independently from each other, the header tank is an integral heat exchanger, and the tubes are positioned independently from each other, and inlets through which the respective heat exchange media are introduced into the header tank are positioned in the same header tank.

3. The heat exchanger of claim 1, wherein the coupling part of the tube has a thickness greater than a thickness of the heat exchange part.

4. The heat exchanger of claim 1, wherein the tube includes a connection part connecting the heat exchange part and the coupling part with each other, and the connection part is inclined at an acute angle with respect to each of extension lines of the heat exchange part and the coupling part.

5. The heat exchanger of claim 4, wherein the tube is an integral tube in which the heat exchange part, the connection part, and the coupling part are connected with one another as one entity by deforming an end of the tube having a constant cross-sectional shape by plastic processing.

6. The heat exchanger of claim 1, wherein the coupling part of the tube has a thickness greater than a thickness of the heat exchange part, and a thickness B of the coupling part of the tube satisfies Equation 2 below:

$$B=\frac{2\times(D-C)+(C\times\pi)-2A}{2}\pm 1.0 \quad \text{(Equation 2)}$$

wherein A is a width of coupling part, C is a thickness of heat exchange part, and D is a width of heat exchange part.

7. The heat exchanger of claim 1, wherein the heat radiation fin is positioned for tubes opposing each other in neighboring rows of the tubes to be coupled together to one heat radiation fin.

8. A heat exchanger comprising:

a header tank including a plurality of flow paths through which a heat exchange medium flows;

multiple rows of tubes connected to the header tank; and a heat radiation fin interposed between the tubes;

wherein the tube includes a heat exchange part coupled to the heat radiation fin and a coupling part positioned at a longitudinal end of the heat exchange part to be coupled to the header tank, and the coupling part has a width less than a width of the heat exchange part, wherein the coupling part of the tube has a thickness greater than a thickness of the heat exchange part, and a thickness B of the coupling part of the tube satisfies Equation 2 below:

$$B=\frac{2\times(D-C)+(C\times\pi)-2A}{2}\pm 1.0 \quad \text{(Equation 2)}$$

wherein A is a width of coupling part, C is a thickness of heat exchange part, and D is a width of heat exchange part.

* * * * *